United States Patent [19]

Chiang

[11] Patent Number: 5,041,011

[45] Date of Patent: Aug. 20, 1991

[54] ROUND COMPUTER CABLE ASSEMBLIES OF D-TYPE CONNECTOR

[76] Inventor: Peter Chiang, 5th Floor, No. 438, Neihu Road, Section 2, Neihu Taipei, Taiwan

[21] Appl. No.: 333,945

[22] Filed: Apr. 6, 1989

[51] Int. Cl.[5] ..... H01R 4/24

[52] U.S. Cl. ..... 439/405; 439/733; 439/607

[58] Field of Search ..... 439/391–407, 439/607, 609, 610, 696, 701, 733

[56] References Cited

U.S. PATENT DOCUMENTS

| | | | |
|---|---|---|---|
| 4,431,248 | 2/1984 | Huntley et al. | 439/405 |
| 4,514,029 | 4/1985 | Lax et al. | 439/610 |
| 4,608,912 | 1/1978 | Hudson et al. | 439/405 |
| 4,619,493 | 10/1986 | Kikuta | 439/404 |
| 4,653,825 | 3/1987 | Olsson | 439/607 |
| 4,668,039 | 5/1987 | Marzili | 439/404 |
| 4,669,801 | 6/1987 | Worth | 439/404 |
| 4,693,533 | 9/1987 | Szczesney et al. | 439/404 |

*Primary Examiner*—David L. Pirlot

*Attorney, Agent, or Firm*—Lowe, Price, LeBlanc, Becker and Shur

[57] ABSTRACT

A connector includes a terminal positioning seat, a wire positioning seat with upper and lower trough portions, and a molded hood housing the wire positioning seat and supporting the terminal positioning seat. Horizontal positioning structure is provided for lockingly engaging the terminal positioning seat and the molded hood to one another. A positioning piece projects vertically from the terminal positioning seat through vertical grooves provided in the upper and lower trough portions in order to position the wire positioning seat accurately with respect to the terminal positioning seat.

8 Claims, 4 Drawing Sheets

ROUND COMPUTER CABLE ASSEMBLIES OF D-TYPE CONNECTOR

BACKGROUND OF THE INVENTION

Figure 1:
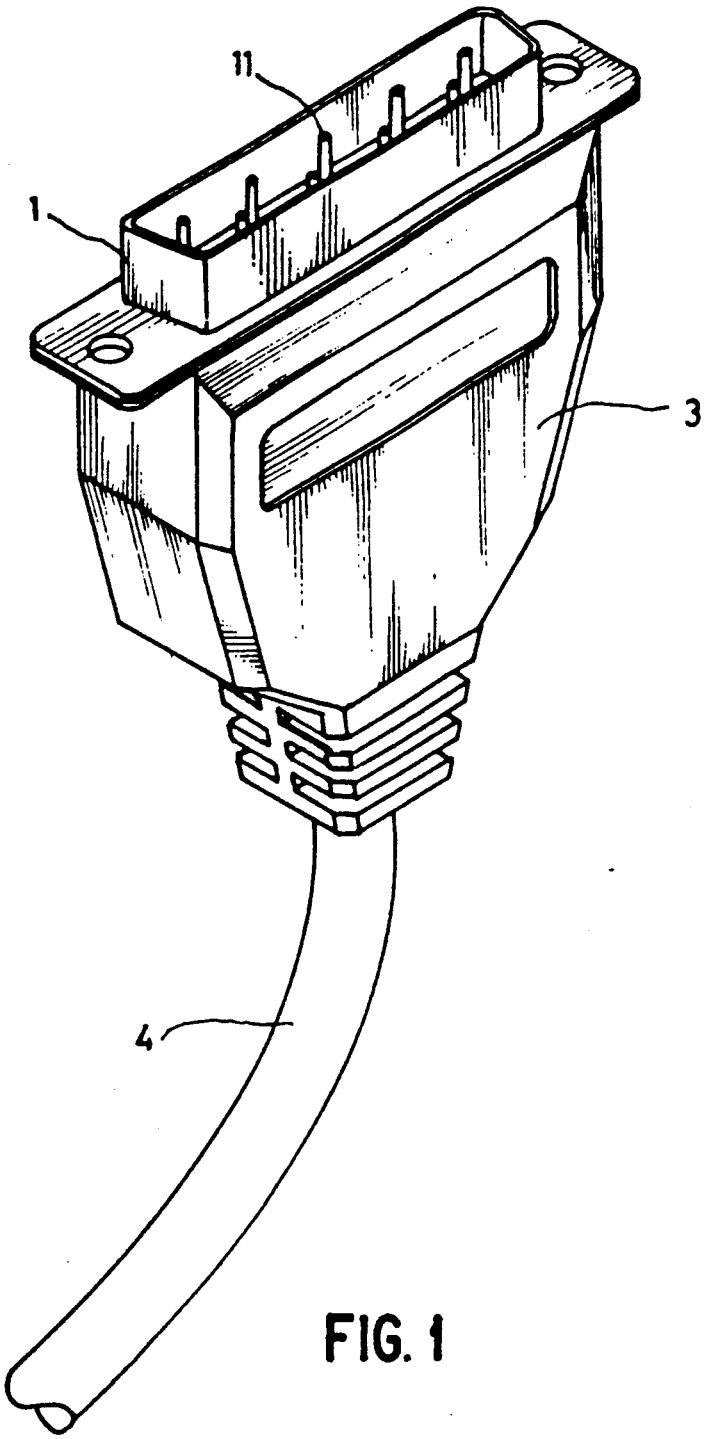

In conventional round computer cable assemblies, such difficulties as maintaining a stable standard of quality, a slow production process, and high costs are often found. The cause of such defects has much to do with two major mechanisms: the connection of multiple terminals of the terminal positioning seat with multiple wires and the wrapping process of the outer hood. In the prior art, the terminal and the wire are processed by welding. However, unsatisfactory connection of the terminal with the wire often results in a falling off because of improper processing. Moreover, as multiple terminals are assembled in a horizontal arrangement, processing is quite difficult due to the close proximity of the intervals. In addition, technical measures such as piercing through and connecting are not yet available for a circular shaped wire. Therefore, the connection of the terminal and the wire in a conventional computer cable assembly must go through the process of repeatedly unwrapping the core wire and welding. Such a complicated procedure is often time consuming and inconvenient for the welder. Furthermore, in the wrapping of the outer hood, the semi-products of the completed welding process are forwarded for the forming process in a molding machine, to have the two pieces of the outer shells locked by means of screws. The aforementioned two methods are not only found to be unsatisfactory in terms of materials, labor, and costs, but the screws are easily loosened. From these defects, it can be seen that the production of conventional computer cable assemblies seriously affects production speed, raises material and labor requirements, as well as costs, which consequently weakens the competitive strength of local manufacturers in the international market.

In view of the various aforementioned defects, the inventor has devoted himself in related research and has managed to successfully present this invention, wherein the molded hood shell that has already been formed is inserted with multiple wires. These wires are then arranged and tightly fixed at will into the wire positioning seat (upper and lower trough chuck), and then sleeved through the terminal positioning seat. At the time of sleeving, the edge of the opening part of the several Y shaped terminals will accurately pierce through the several groove holes, which are set at the upper open slot, in order to access the circular concave groove. It then pierces through the wrapping of the multiple wires to sleeve with the multiple copper wires. At the same time, the positioning iron pieces at the two ends of the terminal positioning seat will also pierce through and tightly clip the groove holes at the two ends of the lower trough (the wire positioning seat) to enable the terminal positioning seat, the wire positioning seat, and the terminal to pierce through the wrapping of the wire, so as to sleeve the copper wire and thus accomplish all of the required procedures. Following this the molded hood, which has already passed through the bottom end of the outer lateral side of the aforementioned Y shaped terminal positioning seat, is sleeved in its final fixing.

The main object of the present invention lies in providing a convenient approach to make pin's assignment steady, simultaneously pierce through by technical chucks; improve productivity highly.

The object, features, and effects of the present invention will be explained in detail by the illustrations of the following drawings:

FIG. 1 is a descriptive drawing of the outer appearance of the present invention.

Figure 2A:
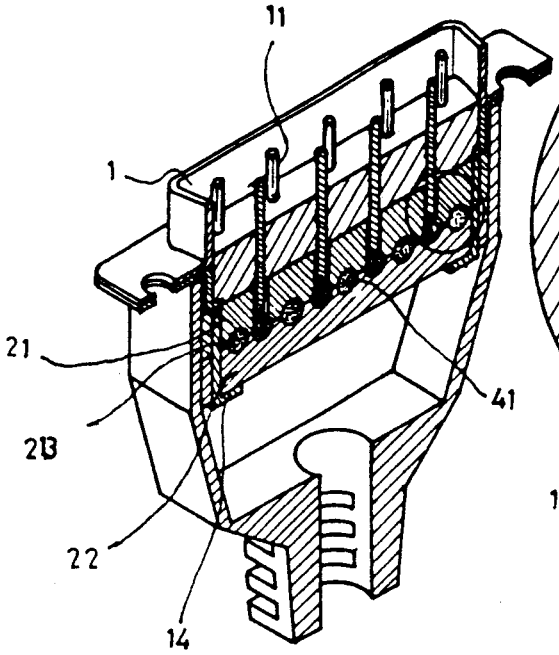
Figure 2B:
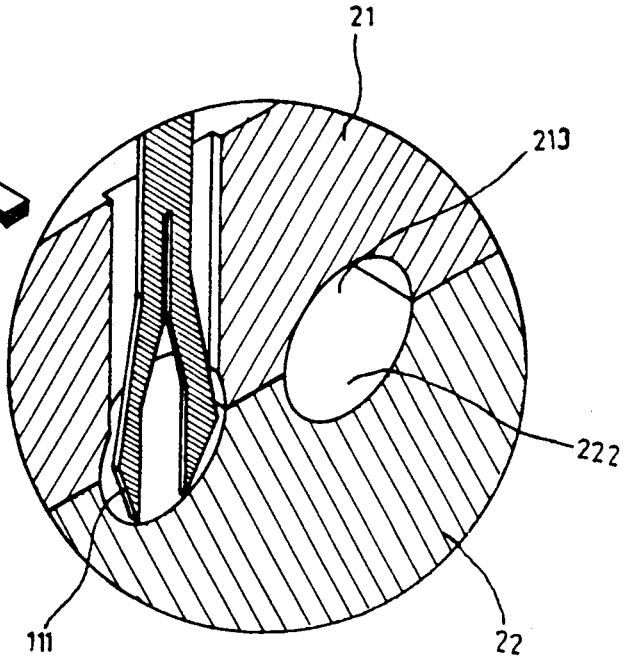

FIG. 2*a* is a solid perspective drawing of the present invention; FIG. 2*b* is an enlarged view of a portion of the invention shown in FIG. 2*a*.

Figures 3A, 3B:
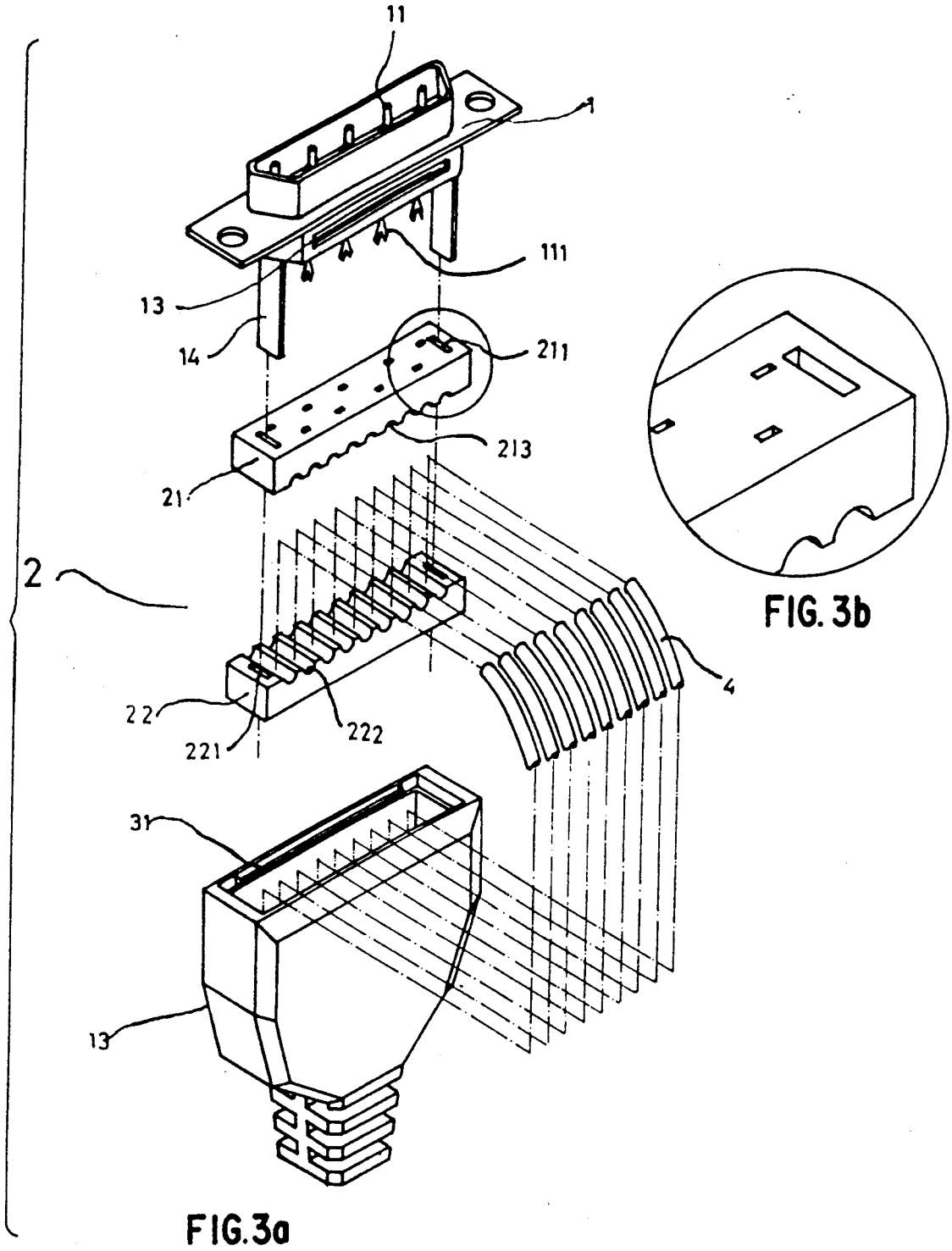
Figure 4A:
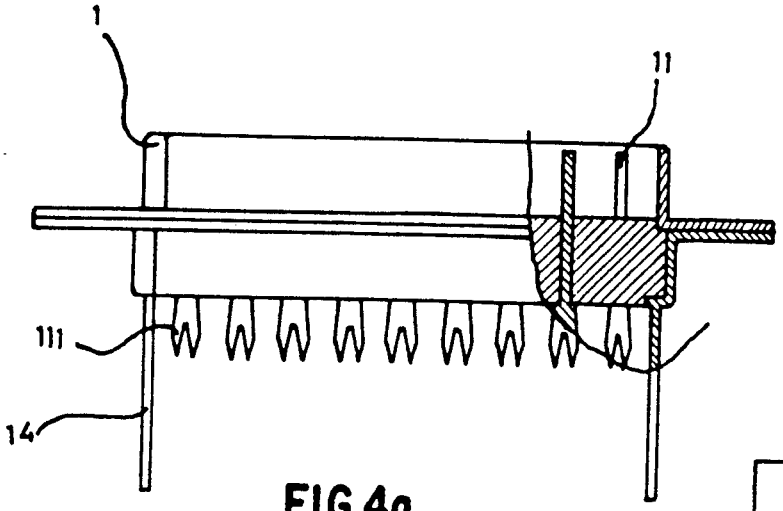
Figure 4B:
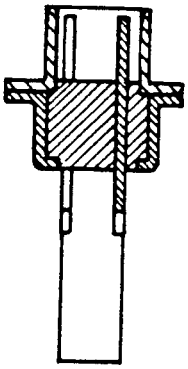
Figure 4C:
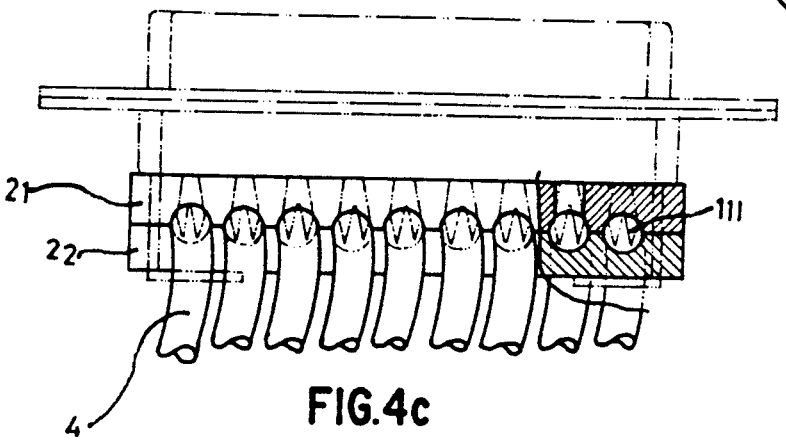
Figure 4D:
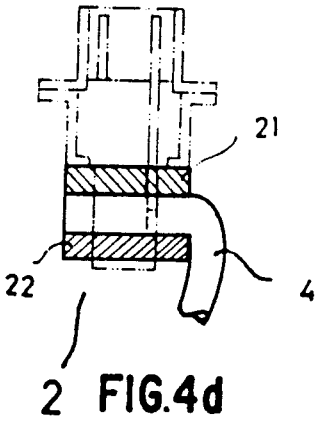

FIG. 3*a* is a solid segmentation drawing of the present invention; FIG. 3*b* is an enlarged view of a portion of the invention shown in FIG. 3*a*.

FIGS. 4*a*–4*d* is descriptive drawing of the motion of the present invention.

Please refer to FIGS. 1 to 4. It can be seen that the present invention includes a terminal positioning seat (1), an electric wire positioning seat (2), a molded hood (3), multiple wires (4), multiple Y shaped terminals (11), and other components, in which an iron piece (14) of electric wire positioning seat (2) is set at an appropriate place on each of the two sides of the terminal positioning seat (1). Also set therein are multiple interlocking terminal positioning chuck holes and horizontally concaved housing grooves (13), which are reserved beforehand on the two sides of the lower end. The electric wire positioning seat (2) consists of upper and lower trough chucks (21. 22.) On the upper trough chuck, multiple interlocking terminal chuck holes (212) are also set, corresponding to the terminal fixing chuck of the terminal positioning seat (1), while an iron piece chuck hole (211) is set at its two ends; multiple circular concave grooves (213) are set at its lower edge; multiple circular concave grooves (222) are set at the upper edge of the lower trough chuck, with iron piece groove holes (221) also set on the two ends. Inside molded hood (3), which has already been formed, there is an internal metal convex edge (31) for housing purposes, in which the Y shaped terminal (11) is tightly fixed to the interior of the terminal positioning seat (1). The electric wires (4) are sleeved through the interior of molded hood (3), which has already been formed. After having tightly clipped the electric wires (4) to the interior of the circular concave grooves (213. 222) of the upper and lower troughs (21. 22), the entire unit of the electric wire positioning seat 2 is then sleeved through the terminal positioning seat (1). At the time of sleeving, the fixing iron piece (14) at the two ends of the terminal positioning seat 1, pierces through the iron piece groove holes (221. 221) at the ends of the electric wire positioning seat (2), in order to be sleeved through the lower end of the terminal positioning seat. As is apparent from FIG. 2, the fixing iron piece (14) includes a vertical portion passing through the iron piece groove holes for horizontally positioning the electric wire positioning seat relative to the terminal positioning seat, and a bottom horizontal portion for vertically positioning the electric wire positioning seat relative to the terminal positioning seat. At the time of sleeving, the opening edge part (111) of the Y shaped terminal (11) will accurately pierce through the terminal groove hole (212) of the upper trough chuck to enter the circular concave groove (213), so as to pierce through the wrapping of the electric wire (4) which houses the copper wire (41). The molded hood (3), which has already been formed, is sleeved through the bottom end into the terminal positioning seat. The two ends are tightly fixed with an iron piece (14) and the horizontally concave groove (13) of the terminal positioning seat interlocks with the internal metal convex edge (31) of molded hood, so as to successfully complete an improved construction of a round computer cable assemblies.

In the assembly of this invention, multiple electric wires (4) are sleeved through the interior of a molded hood (3), which has already been formed. The electric wires (4) are then at will and are tightly clipped inside the electric wire positioning seat (2). While the electric wire positioning seat unit (2) is being sleeved through the terminal positioning seat, the opening edge (111) of the Y shaped terminal (11) is used to pierce the terminal groove hole (212) of the electric wire positioning seat (2) to break through the wrapping of the electric wire (4) and house, the copper wire (41), consequently achieving the object of this invention.

In summary, it is apparent that the improved structure of this round computer cable assemblies proves to be a new model of patent which is innovative, practical, and has never been made known to either the domestic or the overseas markets.

I claim:

1. A connector for an electric cable including a plurality of electric wires each sheathed in an insulator, comprising:

a terminal positioning seat (1) having a plurality of terminals (11) passing therethrough, each terminal including an external terminal portion and an internal Y-shaped opening portion (111) within the connector for piercing the insulation of a sheathed wire and for making electric contact with the electric wire therein;

a wire positioning seat (2) for the sheathed electric wires including an upper trough portion (21) and a lower trough portion (22) having mating plural concave grooves (213) therein for fixedly positioning the sheathed electric wires therebetween;

said upper trough portion including a plurality of passages for said internal Y-shaped opening portions and said lower trough portion backing the sheathed electric wires to provide resistance to said internal Y-shaped opening portions for piercing the insulation thereof; and a molded hood (3) housing said wire positioning seat therein and supporting said terminal positioning seat at an opening therein, wherein said terminal positioning seat includes a positioning piece projecting vertically therefrom, said upper and lower trough portions including vertical grooves for receiving said positioning piece thereby accurately to position said wire positioning seat relative to said terminal positioning seat, and wherein said terminal positioning seat and said molded hood include horizontal positioning means for lockingly engaging said terminal positioning seat and said molded hood to one another to provide accurate positioning thereof.

2. A connector as recited in claim 1 wherein said horizontal positioning means include an internal horizontal convex protrusion from an internal surface of said molded hood and a mating horizontal concave groove on an outer surface of said terminal positioning seat.

3. A connector as recited in claim 1 wherein said positioning piece includes a vertical portion for horizontally positioning said wire positioning seat relative to said terminal positioning seat, and an angled horizontal portion for vertically positioning said wire positioning seat relative to said terminal positioning seat.

4. A connector as recited in claim 1, wherein the electric cable is a round electric cable wherein the plurality of sheathed wires are enclosed in a round cable.

5. A connector for an electric cable including a plurality of electric wires each sheathed in an insulator, comprising:

a terminal positioning seat (1) having a plurality of terminals (11) passing therethrough, each terminal including an external terminal portion and an internal Y-shaped opening portion (111) within the connector for piercing the insulation of a sheathed wire and for making electric contact with the electric wire therein;

a wire positioning seat (2) for the sheathed electric wires including an upper trough portion (21) and a lower trough portion (22) having mating plural concave grooves (213) therein for fixedly positioning the sheathed electric wires therebetween;

said upper trough portion including a plurality of passages for said internal Y-shaped opening portions and said lower trough portion backing the sheathed electric wires to provide resistance to said internal Y-shaped opening portions for piercing the insulation thereof; and a molded hood (3) housing said wire positioning seat therein and supporting said terminal positioning seat at an opening therein, wherein said terminal positioning seat and said molded hood include horizontal positioning means for lockingly engaging said terminal positioning seat and said molded hood to one another to provide accurate positioning thereof.

6. A connector as recited in claim 5 wherein said horizontal positioning means include an internal horizontal convex protrusion from an internal surface of said molded hood and a mating horizontal concave groove on an outer surface of said terminal positioning seat.

7. A connector as recited in claim 5 wherein said terminal positioning seat includes a positioning piece projecting vertically therefrom, and wherein said positioning piece includes:

a vertical portion for horizontally positioning said wire positioning seat relative to said terminal positioning seat, and an angled horizontal portion for vertically positioning said wire positioning seat relative to said terminal positioning seat.

8. A connector as recited in claim 5, wherein the electric cable is a round electric cable wherein the plurality of sheathed wires are enclosed in a round cable.

* * * * *

UNITED STATES PATENT AND TRADEMARK OFFICE

CERTIFICATE OF CORRECTION

PATENT NO. : 5,041,011

DATED : August 20, 1991

INVENTOR(S) : Peter CHIANG

It is certified that error appears in the above-identified patent and that said Letters Patent is hereby corrected as shown below:

Title Page, block [76] Inventor, lines 2 and 3

"Neihu Road, Section 2, Neihu
Taipei, Taiwan"

replace by

--Cheng Kung Road, Section 2, Neihu District
Taipei, Taiwan, R.O.C.--

Signed and Sealed this

Second Day of March, 1993

*Attest:*

STEPHEN G. KUNIN

*Attesting Officer*

*Acting Commissioner of Patents and Trademarks*